US008863630B2

(12) United States Patent
Erlendsson

(10) Patent No.: US 8,863,630 B2
(45) Date of Patent: Oct. 21, 2014

(54) SYNTHETIC ROPE FOR POWERED BLOCKS AND METHODS FOR PRODUCTION

(75) Inventor: Hjortur Erlendsson, Kopavogur (IS)

(73) Assignee: Hampidjan HF, Reykavik (IS)

( * ) Notice: Subject to any disclaimer, the term of this patent is extended or adjusted under 35 U.S.C. 154(b) by 89 days.

(21) Appl. No.: 13/393,760

(22) PCT Filed: Sep. 1, 2010

(86) PCT No.: PCT/IS2010/000012

§ 371 (c)(1),
(2), (4) Date: Mar. 1, 2012

(87) PCT Pub. No.: WO2011/027367

PCT Pub. Date: Mar. 10, 2011

(65) Prior Publication Data

US 2012/0160082 A1 Jun. 28, 2012

(51) Int. Cl.

| | |
|---|---|
| ***D04C 1/12*** | (2006.01) |
| ***D07B 1/16*** | (2006.01) |
| *D07B 1/02* | (2006.01) |
| *D07B 1/18* | (2006.01) |
| *D07B 5/12* | (2006.01) |

(52) U.S. Cl.

CPC ..... *D07B 1/02* (2013.01); *D07B 2501/2038* (2013.01); *D07B 2207/4059* (2013.01); *D07B 2201/102* (2013.01); *D04C 1/12* (2013.01); *D07B 2201/209* (2013.01); *D07B 2207/405* (2013.01); *D07B 2205/2096* (2013.01); *D07B 2201/2074* (2013.01); *D07B 1/025* (2013.01); *D07B 1/165* (2013.01); *D07B 2201/2053* (2013.01); *D07B 2201/2066* (2013.01); *D07B 2201/2089* (2013.01); *D07B 2205/2064* (2013.01); *D07B 2205/2003* (2013.01); *D07B 1/185* (2013.01); *D07B 2201/2048* (2013.01); *D07B 5/12* (2013.01); *D07B 2201/1096* (2013.01); *D07B 2207/4068* (2013.01); *D07B 2401/205* (2013.01); *D07B 2201/2096* (2013.01); *D07B 2201/2095* (2013.01); *D07B 2201/2067* (2013.01); *D07B 2205/2017* (2013.01); *D07B 2205/2042* (2013.01); *D07B 2501/2061* (2013.01)

USPC ..... 87/6; 87/9

(58) Field of Classification Search

USPC ..... 87/6, 8, 9

See application file for complete search history.

(56) References Cited

U.S. PATENT DOCUMENTS

| | | | | |
|---|---|---|---|---|
| 3,960,050 | A * | 6/1976 | Eisler | 87/1 |
| 4,202,164 | A * | 5/1980 | Simpson et al. | 57/232 |
| 4,534,163 | A * | 8/1985 | Schuerch | 57/233 |
| 5,358,262 | A * | 10/1994 | Roberts | 277/652 |
| 6,050,077 | A * | 4/2000 | Muller | 57/210 |
| 6,314,711 | B1 * | 11/2001 | De Angelis | 57/210 |
| 2005/0160714 | A1 * | 7/2005 | Delvael | 57/232 |

* cited by examiner

*Primary Examiner* — Shaun R Hurley
(74) *Attorney, Agent, or Firm* — Donald E. Schreiber

(57) ABSTRACT

Disclosed is a method for producing a high strength synthetic strength member (7) containing rope (1) capable of being used with powered blocks where such rope has lighter weight and similar or greater strength than steel wire strength member containing ropes used with powered blocks. Disclosed also is the product resulting from such method. The product includes a synthetic strength member, a first synthetic portion (9) and a second synthetic portion. The first synthetic portion is enclosed within the strength member and the second synthetic portion is situated external the strength member. At least a portion of the second synthetic portion also is situated internal a sheath (8) formed about the strength member. The second synthetic portion has a minimal of 8% at a temperature of between negative 20 and negative 15° C.

24 Claims, 1 Drawing Sheet

SYNTHETIC ROPE FOR POWERED BLOCKS AND METHODS FOR PRODUCTION

TECHNICAL FIELD

The present disclosure relates generally to the technical field of synthetic ropes and, more particularly, to a rope that preferably is made from synthetic polymeric material, that has a rather high breaking strength and that also has a rather light weight compared to steel wire rope and that is capable of being used with powered blocks, traction winches, powered winches, powered drums, drum winches, powered capstans and in general any powered turning element and/or rotating element capable of applying force to a rope (hereinafter aggregately known as "powered blocks"). Such synthetic ropes include but are not limited to tow ropes, towing warps, trawl warps (also known as "trawlwarps"), deep sea lowering and lifting ropes, powered block rigged mooring ropes, powered block rigged oil derrick anchoring ropes used with blocks and also with powered blocks, superwides and paravane lines used in seismic surveillance including but not limited to used with towed arrays, yachting ropes, rigging ropes for pleasure craft including but not limited to sail craft, running rigging, powered block rigged anchor ropes, drag lines, and the like.

BACKGROUND ART

Due to the high costs of raw materials needed to produce synthetic high strength ropes such as ropes made from state of the art synthetic materials including UHMWPE and others, it is important to increase the both the longevity as well as the strength that can be obtained from synthetic high strength ropes for a given amount of material. In the case of increased longevity, the increase in longevity is important in order to reduce replacement costs. Additionally, the increase in longevity can permit use of lowered diameter and thus lighter and less expensive to deploy ropes as in the present state of the art larger than necessary initial diameters are selected in order to provide for a minimum desired longevity of the rope due to anticipated rates of decrease in rope strength and ultimate longevity. In the case of increased strength, the increase in strength is important both to decrease costs of raw materials and production process, costs of rigging equipment needed to carry, lift, stabilize and stably float and/or otherwise sustain and support the weight of the ropes, as well to decrease drag in water and drag in air of such ropes. In the environment of winches, drums and traction winches, i.e. powered blocks, it is especially important to make such ropes more readily usable on such powered blocks. Furthermore, it is important to increase the life expectancy of such ropes in order to obtain the greatest economic advantage from a given investment in any such rope.

While attempts and methods of adhering a steel wire rope's strength member to a sheath surrounding a steel strength member have failed in increasing the steel wire ropes strength, and actually reduce the steel wire rope's strength for a given diameter (a rope's strength necessarily measured in relation to its diameter) such attempts and methods have succeeding in increasing the longevity of certain steel wire ropes. However, in the case of ropes formed with synthetic and/or mainly synthetic strength members, all known attempts to increase the strength and/or the longevity of synthetic ropes by adhering a sheath surrounding a strength member to the synthetic and/or mainly synthetic strength member have failed to increase either the strength of the rope or its longevity, and in fact do the opposite. That is, known methods of adhering a synthetic rope's strength member to a sheath surrounding such strength member actually decrease both the strength and longevity of the ropes. For this reason, such known constructions increase not only the expense of the rope, but also its diameter and thus associated drags in for example water, as well as its weight and thus associated costs for structures affixing, floating, sustaining or otherwise supporting such ropes. As a consequence, it is contrary to the trend in the industry and against the state of the art to adhere to a synthetic rope's strength member a sheath surrounding such strength member.

As another consequence, it is accurate to state that it is contrary to the trend in the industry and against the state of the art to actually improve a rope's strength by adhering a sheath to the ropes strength member, especially by adhering a sheath to a synthetic and/or mainly synthetic ropes synthetic and/or mainly synthetic strength member, and that such result would be surprising to those skilled in the art.

In the present state of the art, when forming high strength synthetic strength members for use in forming a high strength rope, the strongest synthetic fiber available at a certain price point and suitable for a certain environment of intended deployment is used. It is well known that synthetic high strength ropes have a drawback of being very expensive. Furthermore, synthetic high strength ropes are prone to a much more rapid rate of degradation than natural, e.g. wire ropes, and are quicker to experience abrasion induced failure when used on powered blocks, whether in protected environments or in high temperature and abrasive environments, as opposed to when such synthetic high strength ropes are used in static applications. However, due to their relatively light weights and also due to their relative low diameters for a given strength, and also due to their ability to not rust or oxidize in air and humid environments at an appreciable rate compared to metal fibre ropes, state of the art high strength synthetic ropes, such as ropes made from Vectran®, Zylon® (i.e. PBO), Carbon fibers, Aramids and the like are highly desirable in many applications where light weights and minimal diameters are desired in order to minimize structural loads, to enhance aesthetic appearance such as in pleasure yachting, to minimize the costs of structures to which the ropes affix, and also where low drags are desired such as in towed applications and mooring applications, the relatively low diameters of such synthetic high strength ropes providing for lowered drags compared to other ropes. The present state of the art and the current trend in the industry is that such ropes either do not include a sheath about their synthetic strength member, or that if they do include a sheath that no attempt is made and no construction is provided to adhere the sheath and the strength member to one another. This is because, as mentioned above, known constructions and methods for adhering a synthetic strength member to a sheath surrounding such strength member actually decrease the strength of as well as decrease the longevity of known synthetic ropes, including synthetic ropes for use with powered blocks.

Ropes having sheaths such as plastic sheaths surrounding a strength member, and ropes having synthetic barriers including adhesives and thermoplastics between a strength member and a sheath have failed to be successfully used with powered blocks, whether such ropes are synthetic or natural ropes, and the present state of the art and the current trend in the industry is that natural as well as synthetic strength members used with powered blocks have no such type of sheath, as the cost of forming such sheaths has not been proved to be of benefit. It is understood in the industry that a sheath is not a primary strength bearing unit of a rope, whether a natural or a synthetic rope, but rather that a strength member is the primary strength bearing unit forming a rope. Nonetheless, due to the advantages of lightness of weight that high strength synthetic strength member ropes offer, attempts continue to be made to successfully deploy into industry on a wide scale high strength synthetic strength member ropes for use with powered blocks, such attempts including forming a sheath formed of braided strands about such high strength synthetic strength members in attempt to increase the longevity and thus reduce the long term investment associated with using high strength synthetic ropes. However, the very high costs of such high strength synthetic strength member containing ropes compared to natural high strength ropes, e.g. wire ropes, and the fact that such high strength synthetic strength member containing ropes when used with powered blocks experience rather fast deterioration of their sheaths and ultimately of the synthetic strength members, has resulted in the fact that today only limited market acceptance has been gained for high strength synthetic strength member containing ropes for use with powered blocks. That is, known high strength synthetic strength member containing ropes used with powered blocks are known for rather quickly experiencing abrasion induced failure, and for experiencing a rather rapid strength degradation prior to absolute failure for their cost. Due to the extremely high cost of such ropes, their premature failure and short life spans when used with powered blocks, the adoption of high strength synthetic strength member ropes for use with powered blocks has been limited. For example, the vast majority of the world's trawlers even in highly developed regions continue to use wire rope as trawl warps, despite the great weight and safety concerns caused by such weight when the natural high strength rope is stored on a trawl winch—i.e. vessel instability, it being well known that the weight of such stored wire trawling warps has often been implicated in vessel capsize. Thus, a long felt need continues to exist in the industry for a high strength synthetic strength member containing rope capable of being used with powered blocks that has improved longevity, including improved strength retention over time. Thus also, it can be appreciated that a long felt need continues to exist in the industry for a high strength synthetic strength member containing rope capable of being used with powered blocks that has improved strength.

Published Patent Cooperation Treaty (PCT) International Publication Number WO 2004/020732 A2, International Application Number PCT/IS2003/000025 discloses a cable having a thermoplastic core within a braided synthetic strength member. The cable is a heat stretched cable exhibiting ultra compactness and is useful for high tension powered block applications. In one embodiment, disclosed is a cable wherein the material of the thermoplastic core contacts both the synthetic strength member and a braided synthetic sheath formed about the outside of the strength member. However, this embodiment has failed to be commercially accepted for the reasons taught above, i.e. due to the fact that the strength of the cable is reduced by such construction.

In all embodiments, it is taught that the heat stretching and compacting of the cable is accomplished either by simultaneously heating and stretching with tension the combination of the strength member, the thermoplastic core and a second sheath formed about the thermoplastic core and also contained within the strength member, the purpose of such second sheath being to prevent uncontrolled flow of molten phase of the thermoplastic core during processing of the rope, or by first applying the heat and subsequently applying the tension. This cable has found more commercial acceptance than any other synthetic rope for use with high tension powered blocks, and is the only viable synthetic rope in the known art for use with high tension powered blocks such as trawler winches for purposes such as trawl warps, and this cable and its taught manufacturing processes represent both the state of the art as well as the trend in the industry.

Disclosure

It is an object of the present disclosure to provide for a high strength synthetic strength member containing rope for use with powered blocks that addresses the above stated long felt need in the industry.

It is an object of the present disclosure to provide for a high strength synthetic strength member containing rope capable of being used with powered blocks that exhibits improved strength.

It is another object of the present disclosure to provide for a high strength synthetic strength member containing rope capable of being used with powered blocks that exhibits improved strength retention over time and thus improved longevity.

It is yet another object of the present disclosure to provide for a high strength synthetic strength member containing rope capable of being used with powered blocks that exhibits both improved strength as well as improved strength retention over time and improved longevity.

It is yet another object of the present disclosure to provide for a high strength synthetic strength member containing rope capable of being used with powered blocks and satisfying the above stated objects of the present disclosure where such rope is capable of being used in substitution of steel wire strength member containing ropes for applications including but not limited to trawl warps, anchoring lines, seismic lines, oil derrick anchoring and mooring lines, tow ropes, towing warps, deep sea lowering and lifting ropes, powered block rigged mooring ropes, powered block rigged oil derrick anchoring ropes used with blocks and also with powered blocks, superwides and paravane lines used in seismic surveillance including but not limited to used with towed arrays, yachting ropes, rigging ropes for pleasure craft including but not limited to sail craft, running rigging, powered block rigged anchor ropes, drag lines, climbing ropes, pulling lines and the like.

Disclosed is a method for producing a high strength synthetic strength member containing rope capable of being used with powered blocks where such rope has lighter weight and similar or greater strength than steel wire strength member containing ropes used with powered blocks. Disclosed also is the product resulting from such method. Most broadly, the product includes a synthetic strength member, a first synthetic portion and a second synthetic portion, where the first synthetic portion is enclosed within the strength member and/or mainly is enclosed within the strength member and the second synthetic portion is situated external the strength member and/or mainly is situated external the strength member, at least a portion of the second synthetic portion also being situated internal a sheath formed about the strength member, the first and second synthetic portions having differing elasticity values, the second synthetic portion having greater elasticity than the first synthetic portion. Preferably, the elasticity of the second synthetic portion is in a range of elasticity values as taught herein as useful for an adhesive substance capable of adhering the strength member to the sheath, with a range of elasticity of from twenty percent (20%) to five hundred fifty percent (550%) measured at any temperature, within two (2) degrees Centigrade of zero (0) degrees Centigrade, being preferred, such as preferably at zero degrees Centigrade.

In a most preferred embodiment, an additional synthetic substance is situated and/or mainly situated about and between fibres forming the strength member, the additional synthetic substance capable of being an adhesive substance that adheres one to another various fibres forming the strength member and also preferably has an elasticity that is lesser than the elasticity of the second synthetic portion.

Most broadly, the method for producing the high strength synthetic rope capable of being used with powered blocks is characterized by the steps of:

a) providing a core capable of supporting a hollow strength member and capable of fitting within an internal cavity formed by the hollow strength member, this core forming the first synthetic portion;

b) forming a synthetic strength member about the core;

c) situating about the outside of the strength member a substance capable of being, during at least one of its phases, a substance capable of adhering a substance forming the strength member to a substance forming a sheath, the sheath preferably being a braided sheath formed of strands formed of synthetic fibres; and d) forming the sheath about the outside of both the strength member and the substance capable of being, during at least one of its phases, a substance capable of adhering the substance forming the strength member to the substance forming the sheath, where the substance capable of adhering the substance forming the strength member to the substance forming the sheath has an elasticity that is greater than the elasticity of the core, and that preferably is in the range of elasticity values as taught herein as useful for an adhesive substance capable of adhering the strength member to the sheath, with a range of elasticity of from twenty percent (20%) to five hundred fifty percent (550%) measured at any temperature, within two (2) degrees Centigrade of zero (0) degrees Centigrade being preferred, such as preferably at zero degrees Centigrade.

The substance capable of being, during at least one of its phases, a substance capable of adhering a substance forming the strength member to a substance forming the sheath, forms the second synthetic portion of the rope of the present disclosure.

Most preferably, the method includes the additional step of including about and between fibres forming the strength member a third synthetic substance where such third synthetic substance is capable of adhering one to another various fibres forming the strength member, such third synthetic substance having an elasticity that is lesser than the elasticity of the second synthetic substance.

Due to the disclosed synthetic rope for use with powered blocks light weight compared to steel wire cable coupled with its improved strength, improved strength retention over time and improved longevity, it possesses the advantages of being more buoyant in water than steel wire cable while also being capable of enduring the rigors of use in any of the mentioned applications of use for a longer duration than steel wire cable.

Another advantage of the disclosed synthetic rope for powered blocks is that it permits dramatically reduced superstructures and associated costs for floating mooring and/or anchor lines needed to anchor oil derricks, especially deep water oil derricks and other floating structures.

Yet another advantage of the disclosed synthetic rope for powered blocks is that due to its increased strength less of the rope is required and thus less weight is required to be stored on for example trawler drums, and thus it lowers the center of buoyancy of trawlers using the disclosed rope for trawl warps thereby improving trawler safety.

Yet another advantage of the disclosed synthetic rope for powered blocks is that due to its increased strength less of the rope is required and thus it has a lowered diameter per application requirement, thereby concurrently reducing drags in water and fuel consumption costs associated with pertinent applications including but not limited to trawl warps, superwides and paravane lines, seismic lines anchor lines, deep water oil derrick mooring and/or anchoring lines, drag lines and others as a result of the increased strength of the disclosed rope.

Yet another advantage of the disclosed synthetic rope for powered blocks is that due to its increased strength less of the rope is required and thus it has a lowered diameter per application requirement, thereby reducing costs to produce and acquire the rope.

Possessing the preceding advantages, the disclosed synthetic rope for powered blocks answers needs long felt in the industry.

It can readily be appreciated that these and other features, objects and advantages are able to be understood or apparent to those of ordinary skill in the art from the following detailed description of the preferred embodiment as illustrated in the various drawing figures.

FIGURE LEGEND

1—Synthetic Rope of the Present Disclosure
2—Lead Core
3—Shaped Supportive (Thermoplastic) Core
5—Flow Shield Sheath
7—Strength Member
9—Elastic Adhesive Substance Layer
10—Coverbraid Strands
13—Elastic Adhesive Substance Gap Filling Surface Layer

BEST MODE FOR CARRYING OUT THE DISCLOSURE

Figure 1:
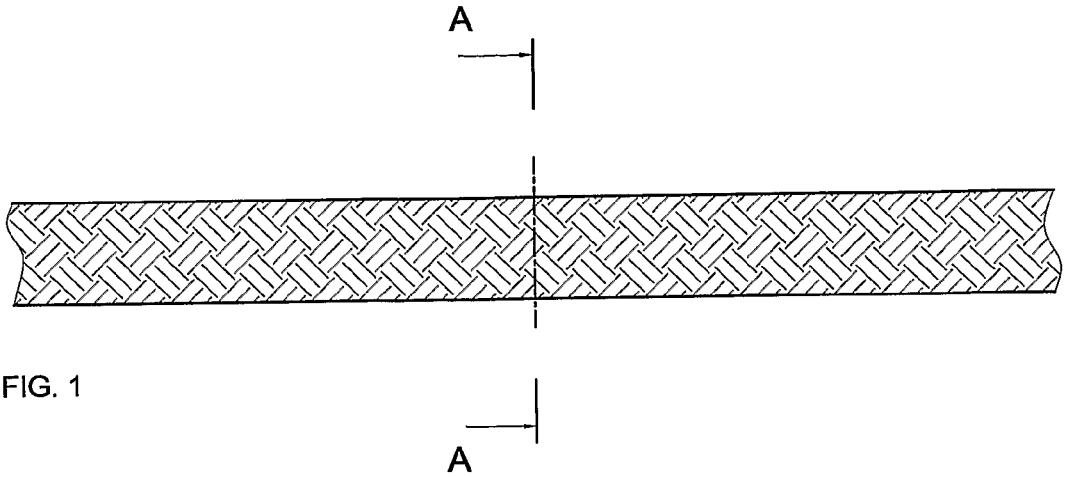
FIG. 1 is a plan view of a portion of a rope of the present disclosure.
Figure 2:
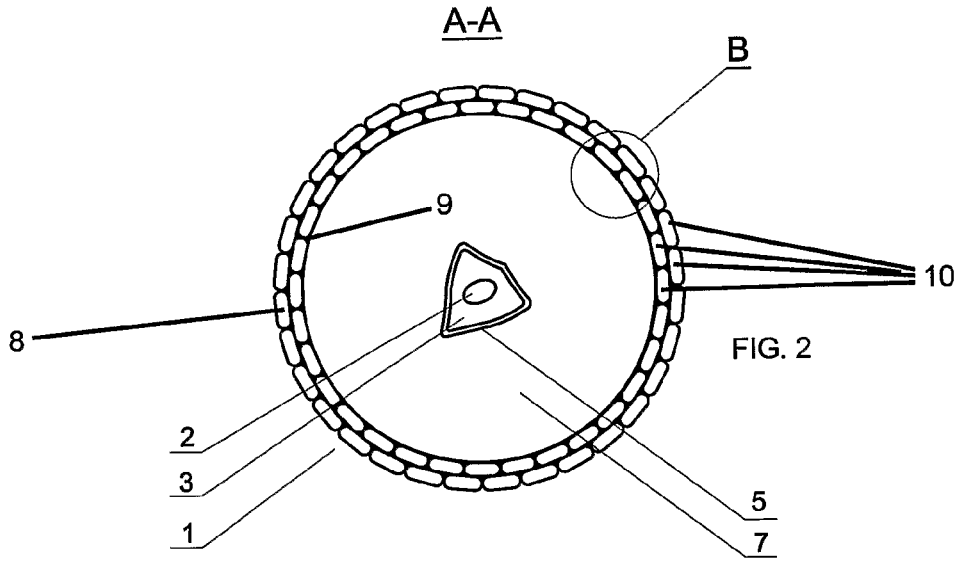
FIG. 2 is a view of a cross section of the rope of the present disclosure taken along line A-A of FIG. 1.
Figure 3:
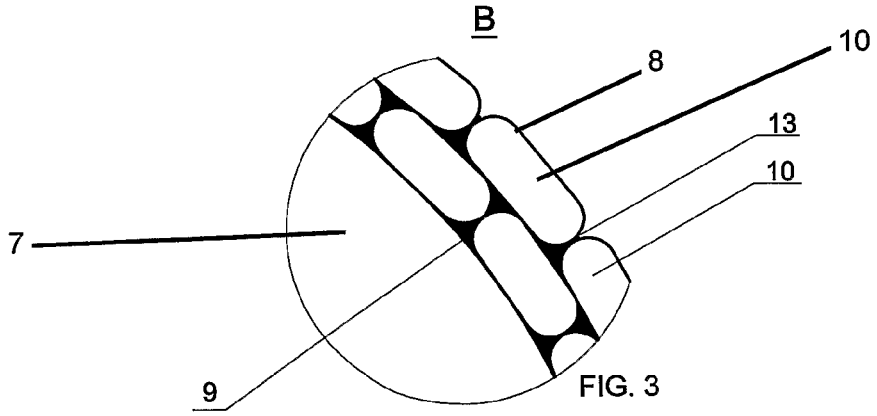
FIG. 3 is an expanded detail view of a portion of the cross section of the rope of the present disclosure shown in FIG. 2 that is indicated by reference character B. The expanded detailed view includes a braided sheath of the rope of the present disclosure, a portion of the strength member of the rope of the present disclosure where such portion of the strength member is proximal the braided sheath, as well as associated structures.

FIG. 2 and FIG. 3 illustrate essential constructional components of one of the most preferred embodiments for use with high tension powered blocks of the rope for powered blocks and winches of the present disclosure that is identified by the general reference character 1. FIG. 2 depicts a preferably thermoplastic shaped supportive core 3 enclosing a lead core 2, the shaped supportive core 3 being enveloped within a flow shield sheath 5. Strength member 7 encloses the combination of the shaped supportive core 3, its enveloping flow shield sheath 5 and its lead core 2. Sheath 8 preferably is of a braided construction and is adhered to strength member 7 by elastic adhesive substance layer 9, that preferably is formed of a settable adhesive substance. Preferably braided sheath 8 is formed of multiple coverbraid strands 10 by use of a braiding machine, the coverbraid strands 10 preferably are of a laid construction. Optionally, and preferably, as shown in more easily visible detail in FIG. 3, elastic adhesive substance gap filling surface layer 13 fills in depressions on the surface of rope 1 formed in between adjacent coverbraid strands 10. Lead core 2 is optional, and is preferred for trawl warp applications and in the case of certain other applications, but not necessarily in the case of anchor lines and deep water oil derrick mooring and/or anchoring lines or yachting lines, although in some cases it may be used in such applications.

Shaped supportive core 3 also defines the first synthetic portion of the rope of the present disclosure mentioned above, and elastic adhesive substance layer 9 also defines the second synthetic portion of the rope of the present disclosure as mentioned above.

The present disclosure is based upon the surprising and shocking discovery that both the strength, the strength retention over time of as well as the longevity of a synthetic high strength rope can be materially increased by adhering to the outside surface of a synthetic strength member a sheath and preferably a tightly braided sheath by use of an adhesive substance exhibiting when in its final, set phase an elasticity of greater than eight percent (8%) when the final set phase of the adhesive substance is measured at any temperature in a temperature range including from negative twenty (−20) degrees Centigrade to negative fifteen (−15) degrees Centigrade. Such result is shocking and surprising because it is contrary to the trend in the industry and against the state of the art. An adhesive substance exhibiting the greater than 8% (eight percent) elasticity at such temperature range also provides for a rope exhibiting the improved strength, improved strength retention over time as well as exhibiting the improved longevity at higher temperatures, and at lower temperatures, even temperatures exceeding seventy (seventy) degrees Centigrade and also even temperatures lower than negative twenty (−20) degrees Centigrade.

In a preferred embodiment of the present disclosure, the adhesive substance exhibits when in its final, set phase an elasticity preferably of greater than ten point one percent (10.1%) when the final set phase of the adhesive substance is measured at a temperature range including from negative fifteen (−15) degrees Centigrade to negative five (−5) degrees Centigrade. An adhesive substance exhibiting the greater than 10.1% (ten point one percent) elasticity at such temperature range also provides for a rope exhibiting the improved strength, improved strength retention over time as well as exhibiting the improved longevity at higher temperatures, and at lower temperatures, even temperatures exceeding seventy (seventy) degrees Centigrade and also even temperatures lower than negative twenty (−25) degrees Centigrade. In an even yet more preferred embodiment the elasticity is preferably at least twenty percent (20%) when measured at any temperature within the above stated temperature range of from negative fifteen (−15) degrees Centigrade to negative five (−5) degrees Centigrade, and even more preferably at least fifty percent (50%) at such temperature range, yet more preferably at least eighty percent (80%) at such temperature range, and yet even more preferably at least one hundred percent (100%) at such temperature range and where the adhesive substance also is capable of exhibiting an elasticity of greater than twenty percent (20%) at temperatures in a range of from room temperature (i.e. twenty-five degrees Centigrade) up to and exceeding forty (40) degrees Centigrade, with an elasticity measured at room temperature of fifty-two percent (52%) to five hundred fifty percent (550%) being preferred and with an elasticity of from one hundred percent (100%) to five hundred fifty percent (550%) or even greater when measured at room temperature being most preferred.

A preferred adhesive substance is one that contains an elastomer or elastomer like substance, and/or an elastomer containing substance, such as a solid elastomer-like polyurethane based upon two, three or more component isocyanate polymer blends and especially with additives and curatives. As taught in further detail herein, the rope of the present disclosure preferably has its primary strength member formed of UHMWPE and/or LCP and/or PBO. An most preferred adhesive substance for adhering the strength member to the sheath is an adhesive substance having at a temperature that is within two (2) degrees of zero (0) degrees Centigrade a minimal elasticity of greater than 20%, preferably of greater than 50%, even more preferably of greater than 100° k, greater than 200%, greater than 300%, greater than 400% and greater than 500%. In general, the greater the elasticity of the adhesive substance over and above 20% at such temperature range, the greater the longevity of the disclosed rope.

Other examples of suitable adhesive substances include silicone, including pure (100%) silicone, as well as a substance that can be made by combining substances known in the industry as "hot melts" with sufficient elastomer and/or elastomeric substances so as to result in a highly elastic hot melt type substance exhibiting the above taught elasticity values at the above taught temperature ranges.

For purposes of the present disclosure, a rope and/or a portion of a rope is considered to be at the above taught temperature ranges, or at a certain temperature range and an elastic substance is considered to be at the above taught temperatures and/or temperature range when such rope and/or elastic substance has been continuously exposed to such temperature range for at least 24 hours. For example, continuously exposed to a temperature of from negative fifteen (−15) degrees Centigrade to negative twenty (−20) degrees Centigrade for a period of time that is at least 24 hours, and when the elastic substance being tested for elasticity, rope and/or portion of rope being tested for its elastic substances elasticity actually is at such temperature range.

As taught supra, a rope having a strength member, and preferably a synthetic strength member, adhered to a sheath and preferably to a synthetic sheath by use of an elastic material exhibiting the above taught elasticity at the above taught temperatures is surprisingly and shockingly able to exhibit both improved strength, improved strength retention over time as well as improved longevity, including improved durability, at a wide range of temperatures including temperatures from but not limited to even temperatures exceeding seventy (seventy) degrees Centigrade and also even temperatures lower than negative twenty (−20) degrees Centigrade, depending largely upon the ability of filaments forming synthetic portions of the rope of the instant disclosure to tolerate a certain temperature.

In order to form the rope of the present disclosure:

In another embodiment a rope of the present disclosure is able to be formed by situating upon the outside surface of a strength member a film or other coating of an adhesive substance having an elasticity preferably of at least 20% when measured at a temperature range of including but not limited to from at least zero degrees Centigrade to at least ten degrees Centigrade, subsequently tightly braiding a braided sheath (including braided cover) about the combination of the strength member and the film or other coating of such adhesive substance, then causing and/or permitting the adhesive substance to set (including cure).

In yet another embodiment a rope of the present disclosure is able to be formed by situating upon the outside surface of a strength member a braided, laid and/or wrapped layer of filaments formed of a substance that is itself formed of a combination of hot melt and sufficient elastomer and/or elastomeric substance so as to permit, when elastomer containing hot melt substance is in a set phase, the elasticity properties at the temperature ranges as taught herein. In such embodiment of the present disclosure: first a strength member is formed; then the filaments are situated upon the outside of the strength member; then the sheath is formed about the combination of the filaments and the strength member; then the combination of the strength member, filaments and sheath are subjected to a predetermined tension and temperature per the fifth and sixth steps described supra for forming a rope of the present disclosure according to the presently most preferred manufacture method.

To further describe such embodiment: preferably a settable adhesive substance is situated upon the outside surface of the strength member, then a braided sheath is tightly braided about the combination of the strength member and the settable adhesive substance, then the settable adhesive substance is allowed to set (including cure). In forming the rope of the present disclosure by the method of this embodiment, preferably the settable adhesive substance is situated upon the outside surface of the strength member in such a fashion that and/or under conditions that preclude the adhesive substance to set until at least that portion of the sheath corresponding to any particular portion of the combination of the strength member and the settable adhesive substance has already been formed about the combination of the strength member and the film or other coating of settable adhesive substance. In other words, preferably the settable adhesive substance and/or the conditions under which it is situated upon the outside surface of the strength member, such as temperature, is/are selected so that the settable adhesive substance sets and/or completely sets only after the sheath has been formed about the outside surface of the strength member, causing the sheath to adhere to the strength member.

To form the rope of the present disclosure by another embodiment of the present disclosure, an adhesive substance including but not limited to either an already set adhesive substance applied to the outside surface of the strength member as powder, a fluid permitted to set, a tape or other wrapping is caused to set prior to forming a sheath about the strength member, or a settable adhesive substance that sets after the sheath is formed about the strength member is/are situated upon the outside surface of the strength member. Next, a braided sheath is tightly braided about the outside surface of the strength member using known methods and preferably from filaments formed and/or mainly formed of the same material as filaments forming the strength member. Then, the combination of the strength member, the adhesive substance situated upon the outside surface of the strength member and the preferably braided sheath formed about the combination of the strength member and the adhesive substance situated on the outside surface of the strength member are heated and/or exposed to radiation, such as microwave radiation, and/or exposed to another catalyst that causes the adhesive substance to undergo a phase change, especially from solid to a liquid state, or from an non-adhesive to an adhesive state, and then the adhesive substance is caused to set, thereby adhering the strength member to the sheath by the adhesive substance, the adhesive substance selected so as to have the elasticity properties for a preferred adhesive substance for practicing the instant disclosure as disclosed herein.

Thus, in forming a rope of the present disclosure, a synthetic rope is formed of a strength member and a braided sheath, the strength member and the braided sheath both formed of synthetic material, the synthetic rope having:

a synthetic substance filling out void spaces between the strength member and the braided sheath and causing adherence of the strength member to the braided sheath, where the synthetic substance exhibits when in a set phase and when at a temperature of:

a) between negative twenty and negative fifteen degrees Centigrade a minimal elasticity of greater than 8%;

b) between negative fifteen and negative five degrees Centigrade a minimal elasticity of greater than 10.1%; and c) between negative fifteen and zero degrees Centigrade a minimal elasticity of greater than 20%.

Furthermore, other elasticity values exhibited at other temperatures, as taught herein, are useful for the synthetic substance that causes adherence of the strength member to the braided sheath.

Importantly, it is surprisingly and shockingly discovered that to maximize both longevity as well as strength of the rope of the present disclosure the synthetic strength member preferably includes a chemical agent contacting the filaments forming the strength member and/or being situated between filaments forming the strength member and/or also including being situated upon the outside surface of the strength member where such chemical agent has a lower elasticity than the elasticity selected for the adhesive substance that adheres a braided sheath to the outside surface of the strength member (for the purposes of the present disclosure, comparative elasticity values are measured at temperature that is between negative zero degrees Centigrade and 10 degrees Centigrade). Such chemical agent may itself be an adhesive agent. The settable adhesive substance preferably is situated upon the outside surface of the strength member as a liquid or as a semi-liquid, the terms "liquid" and "semi-liquid" as used in the present disclosure both also known as "in a flowable state". This includes that the settable adhesive substance may also be situated around, about, so as to envelop or so as to be directly upon the strength member including a strength member having additional chemicals including additional adhesives upon and in between its filaments and/or any other chemical or mechanical barrier upon its outside surface and/or any adhesive substance or other substance upon its outside surface to which the settable adhesive is able to adhere. The braided sheath is then formed about the combination of the strength member and the coating while the substance forming the coating is still liquid and/or semi-liquid (including "flowable"). The set time, also known as the lag time, within which the settable adhesive substance shall set is selected so that during the process of braiding the braided sheath about the strength member the strands forming the braided sheath are adhered to the strength member. Void spaces normally between the strength member and the braided sheath are filled by the settable adhesive substance, and in some preferred embodiments the thickness of the coating, the braiding angle as well as the lag time of the settable adhesive substance are selected so that the settable adhesive substance first is situated upon the outside surface of the strength member, then the braided sheath is braided about the strength member causing the settable adhesive substance both to occupy void spaces between the braided sheath and the strength member as well as to flow between the strands of the braided sheath to the outside surface of the braided sheath, especially during the convergence of such strands at or about the braid point, and remain on the outside surface of the braided sheath. In this case, the method of the present disclosure includes smoothing the settable adhesive substance on and about the outside surface of the braided sheath so that the settable adhesive substance acquires a smooth surface and preferably a generally aesthetically attractive surface.

However, in this embodiment, the amount of the settable adhesive substance that is able to flow between the strands is largely related to the viscosity selected for the settable adhesive substance. When a relatively low viscosity is selected, the settable adhesive substance is able to more readily flow between the strands of the braided sheath. One of ordinary skill in the art having read the present disclosure shall by experimentation be able to readily determine the ideal viscosity for any particular settable adhesive substance, and such experimentally determined values for a viscosity for any particular settable adhesive substance is intended to be encompassed within the scope of the teachings of the present disclosure. When a viscosity is selected for the settable adhesive substance that precludes sufficient of such settable adhesive substance to flow between the converging strands of the braided sheath so as to result in a pre-determined amount of the settable adhesive substance becoming situated upon the outside surface of the braided sheath, an additional amount of the settable adhesive substance may be situated directly upon the outside surface of the braided sheath. Such settable adhesive substance may be situated directly upon the outside surface of the braided sheath by:

a) first passing the rope of the present disclosure with the braided sheath already formed upon the strength member through a bath of a selected settable adhesive substance, and then either:

i) allowing such settable adhesive substance to dry, as is suitable when the viscosity of the settable adhesive substance is sufficiently high so as to allow the settable adhesive substance to acquire an even and/or uniform distribution on and about the outside surface of the braided sheath without further manipulation; or ii) when a relatively high viscosity is selected for the settable adhesive substance, it is preferred to pass the rope having been bathed in the selected settable adhesive substance through a die that is designed, shaped and configured so as to smooth the settable adhesive substance into a desired shape upon the outside surface of the rope of the present disclosure, preferably a circular cross sectional shape, and including into a desired thickness.

Preferably, when the settable adhesive substance is situated upon the outside surface of the braided sheath, the thickness of the layer of the settable adhesive substance on and about the outside surface of the braided sheath is such as to occupy depressions (i.e. valleys) between the strands of the braided sheath, while either not covering, or while lightly covering high points (i.e. peaks) formed by the strands of the braided sheath. In one embodiment, such high points, i.e. peaks, are visible, while the valleys are filled with the settable adhesive substance, as is accomplished by the fact that after some initial wear and surface abrasion any settable adhesive substance present on the peaks is rubbed off, leaving the settable adhesive substance that is located in the valleys. During use, as the rope of the present disclosure is bend over a radius, the compressed side of the bent rope compresses the valley walls, whereby the portion of settable adhesive substance within the valley walls is partially bulged outward where it is able to grip and provide additional traction to the surface upon and about which the rope is being bent.

Importantly, surprisingly, shockingly and contrary to the state of the art and the trend in the industry, in order to obtain both maximal strength as well as maximal strength over time (i.e. longevity) from the rope of the instant disclosure, the strength member is formed of filaments and/or includes filaments that are able to be creeped. For example, filaments are selected that are able to be permanently elongated upon being heated to a temperature approaching or at the phase change temperature of a chemical mainly forming the filaments. Surprisingly, shockingly and contrary to the state of the art that is to employ maximally strong filaments such as Vectran®, Zylon® and others when forming high strength ropes, it has been found that filaments having a lesser strength than such maximally strong filaments, but able to be creeped as taught above, are highly preferably for forming a maximally strong rope of the present disclosure. In fact, surprisingly, shockingly and contrary to the state of the art, a rope of the instant disclosure formed of filaments that are able to be creeped as taught herein, for example filaments formed of UHMWPE, is stronger than a rope formed of stronger and coincidentally more expensive filaments that are not able to be creeped, whether such rope formed of stronger and coincidentally more expensive filaments not able to be creeped is formed by known methods and constructions or by the method and construction of the present disclosure.

Preferred Fabrication Methods

There are two preferred embodiments of the present disclosure: one is a rope of the present disclosure for use in applications where the rope of the present disclosure is subject to storage under high compressive pressure, such as when used with high tension winches and drums, such as when used as a trawler's warp; another is where the rope of the present disclosure is not subject to storage under high compressive pressure, such as is common in many yachting applications.

In forming a preferred embodiment of the present disclosure for use in applications where the rope of the present disclosure is subject to storage under high compressive pressure:

First is provided a strength member formed of synthetic fibres including polyethylene, especially HMWPE, UHMWPE and Liquid Crystal Polymer (LCP). The strength member may be parallel laid, laid (including twisted) or braided. A braided strength member having several strands formed of twisted (laid) filaments is the preferred embodiment. For example a braided strength member having a minimum of eight plates, preferably ten strands, more preferably twelve strands, yet more preferably 14 strand and yet more preferably from 16 strands to 108 strands or even more as the diameter of the rope requires, is preferred. Any conventional construction type for a braided strength member may be used. However, it is highly preferably and important for a preferred embodiment of the instant disclosure that a braided strength member is selected that has a thermoplastic core shaped so as to support the natural interior shape of the braided strength member under tension approaching breaking strength of the strength member. Preferably, for a strength member is provided a braided strength member where the filaments forming the strength member have been creeped after the filaments have been braided into the strength member, rather than prior to braiding the filaments into the strength member, and where the resultant strength member is unable to elongate greater than 5% before reaching break point when measured at a original tension of 1000 Kg, and preferably so that the resultant strength member is unable to elongate greater than 4% before reaching break point when measured at a original tension of 1000 Kg, and yet more preferably is unable to elongate more than 3.6% before reaching break point when measured at a original tension of 1000 Kg.

In forming a strength member for the preferred form of the instant disclosure the following step are employed:

First; filaments are selected that are able to be creeped as taught above and herein.

Second; a thermoplastic linear element is provided that is formed with a thermoplastic that shall be in a liquid state but more preferably that shall be semi-liquid, i.e. in a molten phase when such thermoplastic is at a temperature that either is:

a) a temperature that is slightly below, say one, two, three, four, five, six, or seven degrees Centigrade below a temperature at which the selected filaments experience a phase change; or b) a temperature that is a temperature at which the selected filaments experience a phase change.

The thermoplastic linear element is preferably a rod formed of thermoplastic (the term "formed of thermoplastic" is understood to include being formed of a sufficient quotient of thermoplastic so as to permit the linear element to experience the semi-liquid, i.e. molten phase during the circumstances taught supra and herein, even though other substances might be included with the thermoplastic, or even lead or other metal or heavy plastic might be included in linear arrangement within the center of the thermoplastic linear element that preferably is a rod, so as to increase weight in water of the final product rope of the present disclosure).

Third; a tightly woven braided flow-shield sheath is braided around the thermoplastic rod. Filaments are selected to form the flow-shield sheath that are not made either liquid or semi-liquid at a temperature selected to either or both creep the filaments or change the phase of either the filaments or the thermoplastic rod, but rather that have a much higher softening point. Polyester is suitable.

Fourth; the selected filaments are braided around the linear element formed of a thermoplastic and its flow-shield sheath, such as a thermoplastic rod surrounded by a flow-shield sheath, so as to form a braided strength member including a thermoplastic core surrounded by a flow-shield sheath.

Fifth; the braided strength member having the thermoplastic rod surrounded by the flow-shield sheath as its core is then subject first to tension and secondly to heat, while maintaining the tension, in such a fashion and under such conditions that the filaments forming the braided strength member either reach their phase change temperature or approach sufficiently closely to their phase change temperature so as to permit creeping of the filaments. I.e. so as to permit permanently elongating both the filaments forming the strength member, as well so as to permit permanently elongating the strength member itself. A thermoplastic is selected to form the thermoplastic core that shall preferably become semi-liquid, i.e. molten, at the temperature used to permanently elongate the filaments and braided strength member formed of the filaments. The flow shield-sheath mainly or entirely stops the phase changed thermoplastic core from exiting the flow-shield sheath. That is, the majority of the thermoplastic core is unable to exit the flow-shield sheath even when the thermoplastic core is either liquid or semi-liquid, i.e. molten, despite enormous constrictive and compressive forces applied to the phase changed thermoplastic core as a result of the high tensions applied to the strength member, such high tensions able to permanently elongate the strength member under the conditions taught supra and herein.

Applying the tension before applying the heat while then maintaining the tension while the heat is being applied is, in combination, contrary to the trend in the industry and against the state of the art. A preferred tension to be used in the disclosed processes for forming the disclosed rope is about three percent (3%) to about fifteen percent (15%) of the break strength of the strength member when such break strength is measured at room temperature, with about three percent (3%) to about seven percent (7%) being preferred, and with less than fifty percent (50%) being most important.

Importantly, the tension applied to the strength member, and thus necessarily also applied to the filaments forming the strength member, preferably is a static tension and/or a generally static tension and/or a very slowly fluctuating tension. After applying a predetermined tension (including approximately a predetermined tension), and while under such predetermined tension simultaneously the strength member, its filaments, and its thermoplastic core are heated to a predetermined temperature and/or to approximately a predetermined temperature as taught above and herein, with a minimum temperature of eighty (80) degrees Centigrade being most preferred, and temperatures that approach the phase change temperature of whatever filament in the strength member has a lowest phase change temperature being highly useful. The use of a long oven having many capstans able to accommodate a very long length of the strength member and turning at varying speeds and/or rates of rotation so as to maintain the tension on differing portions of the strength member located between different capstans, and thus by extension on the filaments forming the strength member as well as on the thermoplastic core also forming the strength member is highly useful, especially for permitting an endless flow production process.

Sixth; when the filaments and thus by extension the braided strength member have been elongated to a predetermined amount so as to permit a strength member having the properties described above and herein, and especially having an elongation to break point within the range of values as taught above and herein, and also the thermoplastic core has been elongated, the elongated filaments, the now elongated strength member formed of the elongated filaments and its elongated thermoplastic core are cooled while sufficient tension is maintained and applied to the strength member and thus by extension to its filaments and to its thermoplastic core during the cooling process so that all such components are cooled to their respective solid states while under a tension that results in the cooled filaments as well as the cooled strength member having been permanently elongated so as to cause the strength member:

a) to acquire a lower elongation than it had prior to its having been permanently elongated;

b) to acquire a substantially lesser diameter and a greater compactness than it had prior to its having been permanently elongated;

c) to acquire to its thermoplastic content core a permanent solid shape that supports the interior cavity of the permanently elongated strength member in such a fashion that the filaments and braid strands forming the strength member are sufficiently less able to move relative to one another in a direction perpendicular to the long dimension of the permanently elongated strength member in comparison to prior to the strength member having been permanently elongated so as to reduce filament to filament abrasive wear, and also so as to preclude crushing of the rope, especially under high compressive forces such as occurs during winding and storage on a high tension drum, the necessary tension to achieve such result for any particular filament type able to be experimentally determined by one of ordinary skill in the art after having read the present disclosure; and also d) to acquire a break point that is within the range of values of elongation to break point as taught above and herein.

This cooling also is best accomplished and undertaken using capstans turning at varying speeds so as to maintain a tension on the elongated strength member and its components during the entire cooling process and period that precludes their shortening, so that the final cooled strength member has the values of elongation to break point as taught above and herein for a most preferred embodiment of the instant disclosure, and also the other properties taught as above and herein, as also is accomplishable in an endless flow production method.

In order to form a rope of the instant disclosure that is not useful for applications requiring tolerating high compressive pressures, such as applications not including a trawler's warp, and other applications not including storage of the rope of the present disclosure on high tension drums and winches, the step of forming the thermoplastic rod with its flow-shield sheath is omitted, and the subsequent steps are carried out the same as taught above and herein except that the thermoplastic rod and its flow-shield sheath are not present nor need their properties be considered.

Seventh; while the flowable settable adhesive substance is still liquid and/or semi-liquid (including "flowable") it is situated upon the outside surface of the preferably permanently elongated strength member, then a preferably braided sheath is formed about the combination of the permanently elongated strength member and the flowable settable adhesive substance. The temperature of the settable adhesive substance at the time when it contacts the strength member preferably is less than eighty (80) degrees Centigrade, and also preferably less than 117% Centigrade, and at a temperature that shall not damage the synthetic filaments contacting the adhesive substance. In other words, the settable adhesive substance is situated upon the strength member at temperature that is lower than a phase change temperature of fibres forming the strength member, and preferably also lower than a phase change temperature of fibres forming a braided sheath to be formed about the strength member as taught in subsequent steps of the disclosed method. Preferably, the strength member is under a tension that increases the temperature that filaments forming the strength member are able to tolerate when situating upon the strength member the settable adhesive substance, and similarly the braids of the braided sheath are also under such a tension. The braid point, braid tension, thickness of the coating, viscosity of the settable substance and lag time can be selected so that no or minimal flow of the flowable settable adhesive substance to the outside surface of the braided sheath occurs. Or, the braid point, braid tension, thickness of the coating and lag time may be selected so that a flow of sufficient volume of the settable adhesive substance to the outside surface of the braided sheath occurs so as to permit smoothing that portion of the settable adhesive substance that flowed to the outside surface of the braided sheath into a smooth coating about the braided sheath. A lag time, also known as a "set time", of at least 15 seconds is preferred, with at least one minute being more preferred, with at least 2 minutes being yet more preferred, with at least 3 minutes being even yet more preferred, with at least 4 minutes being yet again more preferred, with at least 5 minutes being even more preferred, with at least 6 minutes, at least 7 minutes, at least 8 minutes, at least 9 minutes, at least 10 minutes, at least 11 minutes, at least 12 minutes, at least 13 minutes, and least 14 minutes being most preferred, and with up to one hour or even more being useful. Thus, the method includes selecting for a lag time any of the above mentioned preferred lag times, with at least 15 seconds being the minimal preferred lag time.

In order to prepare the outside of the strength member and possibly as well the inside of the strands converging to form the braided sheath for adhesion via the adhesive substance, electricity preferably is applied to the surface of preferably the strength member, and possibly also to the strands forming the braided sheath, at a stage in the production process that is immediately before the deposition of the settable adhesive substance onto the surface of the strength member. This can be accomplished by Corona treatment (e.g. air plasma method and treatment), or by Atmospheric Plasma method and treatment, Flame Plasma method and treatment or Chemical Plasma method and treatment. A brush—the term "brush" in this instance as used in electrical energy applications, having a circular dimension through which passes at least the strength member is preferred for utilization of the Corona treatment. While it has been described that this production method embodiment is used when employing a flowable, settable adhesive substance, it also can be used when employing production methods including situating upon the outside surface of the strength member solid, including powder, phase changeable substances capable of causing adherence of the strength member to the sheath.

A presently preferred method includes using a polyurethane blending machine (e.g. a mixing machine) having an injection head constructed, designed and configured to situate the desired coating of the flowable adhesive substance about the outside surface of the braided sheath. This may be done by configuring the injection head either to spray, extrude a bead, or pour a stream. Then, the flowable adhesive substance may be situated onto the outside surface of the strength member by spraying the settable adhesive substance onto the strength member, or alternatively by passing the strength member through a bath of such substance, or again alternatively by pouring such substance directly onto the strength member. If direct spraying or pouring is selected, the injection head is positioned adjacent to the outside surface of a length of the strength member. The strength member is fed out from a pay out spool while simultaneously being taken up on a take up spool. The braided sheath is formed about the strength member as described using usual methods for forming a braided sheath about a strength member. Preferably, the braid point is immediately behind (i.e. downstream of) either the application point of the flowable adhesive substance onto the strength member's outside surface, or is immediately downstream of a die that itself is immediately downstream of the application point of the flowable adhesive substance onto the strength member's outside surface, so that the strands of the braided sheath are pressed into the flowable adhesive substance and pressed onto the outside surface of the strength member prior to and preferably immediately prior to the flowable adhesive substance setting (i.e. solidifying), and becoming solid. The flowable adhesive substance in its set, and especially in a solid form, then occupies void spaces both between the strands of the braided sheath as well as between the strands of the braided sheath and the outside surface of the strength member, thus sealing off the braided sheath so that impurities and water cannot pass through the braided sheath to the strength member. Furthermore, the flowable adhesive substance both occupies void spaces between the braided sheath and the outside surface of the strength member, while also adhering the braided sheath to the strength member.

When using the die downstream of the application point of the flowable adhesive substance onto the outside surface of the strength member, the die is designed, constructed, configured and positioned so as to distribute more or less uniformly about the outside surface of the strength member the flowable adhesive substance. The surfaces of the die are selected of a material that shall not bind to the flowable settable adhesive substance. As mentioned supra, the braid point is immediately downstream of such die, for the reasons described supra.

The thickness of the layer of the set adhesive substance, i.e. the solid phase of the adhesive substance, at its widest zone between the inside surface of the braided sheath and the outside surface of the strength member, is selected so as to be less than 5% of the overall radius of the finished rope, and preferably is less than 4% of such radius, yet preferably less than 3% of such radius, yet more preferably less than 2% of such radius, yet even more preferably less than 1% of such radius, and yet again even more preferably less than 2 mm in thickness, and even more preferably less than 1 mm in thickness, and yet even more preferably less than 0.5 mm in thickness, and even yet again more preferably less than 0.25 mm in thickness, and again even more preferably less than 0.15 mm in thickness.

If the option of selecting the braid point, braid tension, thickness of the coating, viscosity of the settable adhesive substance and lag time so as to cause some of the flowable adhesive substance to be forced through the strands forming the braided sheath to the outside surface of the braided sheath is selected, then the coverbraided strength member can pass through a second die that smoothes the settable adhesive substance about the outside surface of the braided sheath. The surfaces of this second die also are of a material selected so as to not adhere to the settable adhesive substance, as are the ambient temperatures about the region of the die selected to preclude premature setting of the adhesive substance while contacting the die. If it is desired to use heat to set the settable adhesive substance, this step may be done in a linearly shaped oven of about one to fifteen meters in length, or lesser if lesser is sufficient, that the coverbraided strength member is passed through prior to being wound up on the take up spool, but after passing through the second die if such second die step is selected, with the take up spool located downstream of as well as external of the oven. The second die preferably is located immediately downstream of the braid point.

It is useful for the method of the present disclosure that the flowable adhesive substance is dried, i.e. solid, prior to contacting machinery or portions of machinery other than the dies, and especially prior to the combination of the strength member, the adhesive substance and the braided sheath being bent, such as being bent about a wheel, capstan, pulley, winch, block or the like. Furthermore, it is useful that the adhesive substance is set, including dried, prior to contacting objects other than the strength member and strands of the braided sheath, especially objects that pull upon the outside surface of the braided sheath. However, if it is not possible to enact such teachings, it is important that the set time permit cleaning of the machinery from excess of the settable adhesive substance prior to its setting.

For the settable adhesive substance polyurethane is preferred. Passing through the oven, or otherwise in a controlled environment facilitating setting of the settable adhesive substance, sufficient heat is applied in sufficient lack of humidity so as to accelerate adherence of the polyurethane or other settable adhesive substance to both the outside surface of the strength member and also to the inside surface of the braided sheath, and in some cases to the outside surface of the braided sheath.

Substances that accelerate the setting into a solid of the polyurethane material or other settable adhesive substance, as are conventionally known in the art, are selected for use with and in the polyurethane blending machine. That is, such substances are blended with the polyurethane or other settable adhesive substance just prior to the settable adhesive substance being applied to the outside surface of the strength member.

Additionally, substances that reduce drag and/or increase the elasticity of the settable adhesive substance may be used, as well as substances that increase its abrasion tolerance, and resistance to degradation by elements such as light, heat, cold and salt water can be added to the flowable settable adhesive substance prior to its being situated onto the outside surface of the strength member. Furthermore, substances that affect its affinity to water, such as silicon or Teflon, or in certain applications substances that enhance its affinity to water, can be blended with the flowable settable adhesive substance.

The elasticity and/or also an elastomeric substance content of the final and set phase of the settable adhesive substance is selected so that such set substance does not prematurely crack or separate from the inside surface of the braided sheath or from the outside surface of the strength member during use, including bending about sheaves and blocks suitable for any particular diameter of the rope. The elasticity for the final, set phase of the settable adhesive substance is as taught supra at the temperature range taught supra, and at temperatures exceeding negative 15 (−15) degrees Centigrade preferably is of from 20% to 550%, or even greater.

It is considered important for maximal strength and longevity of the rope of instant disclosure that the strength member itself as well as the filaments and strands forming the strength member be contacted with an adhesive chemical agent, such as a chemical agent suitable for use with filaments formed of UHMWPE and LCP. Preferably, prior to the step of providing the strength member, a step of removing some and preferably all or nearly all humidity from the strength member followed by a step of adding the chemical adhesive agent to the strength member is selected. Then, the strength member containing the chemical adhesive agent is provided, and the settable adhesive substance situated on the strength member's outside surface prior to the step of braiding the braided sheath about the strength member. As taught above, the outside surface of the strength member preferably includes the chemical adhesive agent that also is including within the body of the strength member, especially in, about, between and among the filaments and strands forming the strength member.

As taught above and herein, preferably such chemical adhesive agent has an elasticity during its set phase that is lesser than the elasticity of the set phase of the settable adhesive substance. Furthermore, preferably the set phase of the chemical adhesive agent has a friction when wet with water that is greater than is a friction when wet with water of the set phase of the settable adhesive substance.

Preferably, the strength member's chemical adhesive agent includes a material having a friction when wet with water and especially salt water that is a friction sufficient to measurably increase the splice strength of the strength member.

In one embodiment of the present disclosure that is a presently preferred embodiment, the braid angle of the braided sheath is greater than the braid angle of the strength member. However, in some cases the braid angle of the braided sheath may be lesser than, or same as the braid angle of the strength member.

Preferably, the settable adhesive substance differs from the chemical adhesive agent, as taught above and herein. However, in some applications they may be the same or similar, though such applications are not preferred.

It is important to the strength and longevity of the synthetic rope of the present disclosure that the proportion of the cross sectional area of the synthetic rope of the instant disclosure that is occupied by the strength member be at least 40% of the total cross sectional area of the rope, and preferably at least 50% of the total cross sectional area of the rope, and yet more preferably at least 60%, at least 65%, at least 70%, at least 75%, at least 80%, at least 85%, at least 90% and/or at least 95% of the total cross sectional area of the rope. This insures that when bending over powered blocks, capstans, traction winches, sheaves and the like that a suitable surface area of the outside surface of the rope presses upon the strength member so as to not cause premature failure of the settable adhesive substance.

When the strength member of the rope of instant disclosure includes a pre-heat stretched strength member, or includes a pre-heat stretched strength member having a core shaped so as to support the naturally occurring interior shape of the strength member, or further includes within the strength member any amount of conductors, whether copper, fibre optic or the like, water and/or electrical shields, and other, it is important to the strength and longevity of the synthetic rope of the present disclosure that the proportion of the cross sectional area of the synthetic rope of the instant disclosure that is occupied by the combination of the strength member and anything enveloped by the strength member be at least 30% of the total cross sectional area of the rope and more preferably at least 40% of the total cross sectional area of the rope, and preferably at least 50% of the total cross sectional area of the rope, and yet more preferably at least 60%, at least 65%, at least 70%, at least 75%, at least 80%, at least 85%, at least 90% and/or at least 95% of the total cross sectional area of the rope. This insures that when bending over powered blocks, capstans, traction winches, sheaves and the like that a suitable surface area of the outside surface of the rope presses upon the strength member so as to not cause premature failure of the settable adhesive substance.

In a most highly preferred embodiment of the present disclosure, the thickness of the wall of the braided sheath is less than 16 mm (sixteen millimeters), and better less than 14 mm (fourteen millimeters), better yet less than 12 mm (twelve millimeters), yet again better less than 10 mm (ten millimeters), yet again even more better less than 8 mm (eight millimeter), and preferably less than 7 mm (seven millimeter), and more preferably less than 6 mm (six millimeter), and yet more preferably less than 5 mm (five millimeter), yet even more preferably less than 4 mm (four millimeter), further preferably less than 3.5 mm (three point five millimeter), yet most preferably not more than 3 mm (three millimeter), with approximately from 2 mm (two millimeter) to 3 mm (three millimeter) being preferred, with at least 0.5 mm (half a millimeter) being useful, depending upon the application intended for the synthetic rope of the instant disclosure.

Preferred Spliced Eye and Sling Fabrication Methods

A preferred method of manufacturing and using the disclosed rope is to manufacture a section of the disclosed rope with an eye spliced at each end of the section of disclosed rope. A section of the disclosed rope having an eye spliced at each end also is known as a "sling" of the disclosed rope or as a "spliced eye sling" of the disclosed rope. The known art does not teach a suitably strong method for forming spliced eyes in a tightly coverbraided ropes. Following is a presently preferred method for forming a spliced eye into each end of a section of the disclosed rope, i.e. for forming a sling of the disclosed rope. A section of the disclosed rope with a spliced eye formed into each end of such section, i.e. a sling of the disclosed rope, is most suitable for use in any of the applications and uses mentioned herein as well as any other applications and uses.

Preferred Sling Production Method

Terminology

"Strength Member Core" also means "strength member"

Step One: a predetermined length of strength member core is selected (the predetermined length of strength member core hereinafter referred to as the "core rope"). The core rope preferably is a hollow braided rope. When the core rope is intended for applications including but not limited to seismic applications, paravane lines, seismic lines, yachting lines, rigging lines, anchoring lines, deep water oil rig mooring lines, towing warps and trawler towing warps and any other uses for rope, cable or chain, and also such as when the core rope is made from a UHMWPE, a maximal amount of a suitable impregnation substance included within the strength member has been found to be advantageous.

Step Two: an eye is spliced at one end of the length of the core rope, and preferably an eye is spliced at both ends of the length of the core rope, forming a core rope sling. The preferred splice method is to insert the cut end of the core rope into the hollow body of the hollow braided core rope by opening up the braid of the core rope and passing the cut end and the part of the core rope intended to form the inserted portion of core rope forming part of the splice braid zone into the body of the core rope intended to form the external portion of the core rope forming part of the splice braid zone, and then either leaving the cut end of the core rope enclosed within the hollow body of the core rope in the intended splice braid zone or pulling the cut end of the core rope out of the body of the core rope at a point that is at an end of the splice braid zone that is farthest from the eye formed by this process.

Step Three: several core rope slings are attached to one another in order to form a linear element formed of a series of such core rope slings. The various core rope slings are attached to one another to form such linear element by connecting subsequent (and/or intended to be subsequent) core rope slings eye to eye with sections of twine, the twine forming such sections of twine hereinafter also known as "connecting twine". An intermediate length of connecting twine is left in between the interconnected eyes of each subsequent core rope sling so that such intermediate length of connecting twine is about from five centimeters to 200 centimeters in length, or even more, depending upon the ultimate length of the splice braid zone to be coverbraided. This intermediate length of connecting twine equals approximately double the length of any core rope sling's splice braid zone, or is even about double such length plus an additional five to twenty centimeters.

Step Four: the interconnected core rope slings are wound upon a reel and/or spool that shall be used with or in conjunction with a feed out spool and/or a feed out wheel of a conventional braiding machine designed and configured to form braided sheaths about lengths of rope and/or other linear elements. Care is taken to impart minimal and preferably no rotation to the core rope slings so as to avoid imparting torque to the final finished product. In all cases care is taken to ensure that the core rope slings remain torque free, i.e. lacking a tendency to rotate about their longitudinal axis when tension is applied to the core rope sling and/or to the finished product.

Step Five: a length of twine is passed over the take up wheel and affixed to the take up spool at one end, such length of twine hereinafter also known as the "take up twine". At another location on the length of take up twine that corresponds to a location intended for the braid point the various strands forming the braided sheath, also are attached to the take up twine. Care is taken to ensure that sufficient length of the take up twine remains upstream of the braid point to permit future knotting and connecting as is described further below, and that such upstream portion of the take up twine is retained outside of the converging braid strands in order to preclude it becoming covered by or enclosed within a hollow braided sheath that is intended to be formed, such withdrawn portion of the take up twine also to be known hereinafter as the "withdrawn portion of take up twine".

Step Six: the operation of the braiding machine is started causing a hollow braided sheath formed of the strands to be formed, if one is to be formed, such as when forming a braided sheath with the process of the present disclosure.

Step Seven: after a predetermined length of the hollow braided sheath is formed, such predetermined length corresponding to about twice the length of the splice braid zone of any eye of any core rope sling being used as a strength member core, plus an additional about ten to twenty centimeters to be used for future steps, the braiding machines operations are paused.

Step Eight: an eye of a first core rope sling that also is an eye forming the distal end of the linear element formed of several interconnected core rope slings and at least a corresponding splice braid zone of the same first core rope sling's eye are inserted into the interior zone of the converging strands forming the hollow braided sheath, and then the eye is withdrawn from within the interior zone of the converging strands forming the hollow braided sheath by passing it through the converging strands forming the hollow braided sheath proximal where such strands enter the braid point.

Step Nine: the withdrawn eye is extended and collapsed, i.e. not opened, and is laid alongside the section of hollow braided sheath formed as a result of the above steps so that the base of the eye, i.e. that portion of the open eye most proximal the splice braid zone, is near the braid point, and the furthest portion of the eye from the base of the eye is further downstream from the braid point.

Step Ten: The action of the braiding machine is started briefly so as to make preferably one wrap, and up to two, three or four wraps of the strands forming the braided sheath about the splice braid zone adjacent the withdrawn eye, then the action of the braiding machine is again paused.

Step Eleven: The withdrawn portion of take up twine is passed through the withdrawn eye of the first core rope sling and knotted back on itself so as to affix the withdrawn eye of the first core rope sling to the withdrawn portion of take up twine, thus attaching the withdrawn eye to the take up wheel thereby allowing to impart traction to the withdrawn eye and thus to the entire core rope sling and any other core rope slings connected to it.

Step Twelve: the hollow braided sheath is severed just upstream of the point where the withdrawn length of twine attaches to the hollow braided sheath.

Step Thirteen: While the braiding action of the braiding machine is retained as paused, the take up spool is energized so as to advance downstream the hollow braided sheath and the braid point, thus tightening the withdrawn portion of take up twine connecting the hollow braided sheath and the withdrawn eye.

Step Fourteen: the upstream severed length of hollow braided sheath is now bent back (i.e. "doubled back") and passed through the withdrawn eye and then passed into the interior zone of the converging strands forming the hollow braided sheath and then laid alongside the splice braid zone corresponding to the withdrawn eye.

Step Fifteen: the take up wheel is now, if necessary, reversed from its take up direction to a pay out direction so as to cause the braid tension to become reduced and also so as to cause the braid angle to become more obtuse, until the braid angle is nearer to eighty-nine degrees than it is to seventy degrees when measured between the braid ring and a converging strand used in forming the hollow braided sheath, with a braid angle of about eighty to eighty-seven degrees being also useful, with the result that the core rope sling's material is not visible to an unaided eye after the braided sheath has been formed about the splice braid zone of the core rope sling.

Step Sixteen: the action of the braiding machine is then commenced again, including that the take up spool again commences to rotate in a "take up" direction, causing the braided sheath to form about the splice braid zone corresponding to the withdrawn eye.

Step Seventeen: when the braid point is proximal the point of the splice braid zone that is furthest from the withdrawn eye, the action of the braiding machine is again paused.

Step Eighteen: the take up spool is advanced while the action of the braiding machine remains paused, so as to increase the braid tension and also so as to create a less obtuse (i.e. more acute) braid angle, with the result that the core rope sling's material is not visible after the braided sheath has been formed about a portion of the core rope sling not having a splice braid zone.

Step Nineteen: the action of the braiding machine is again started and continued to operate so as to cause the braided sheath to form about the length of core rope sling up to the point that a portion of the next splice braid zone arrives at the braid point.

Step Twenty: the action of the braiding machine is again paused, and the take up spool is again reversed, again reducing the braid tension and again causing the braid angle to become more obtuse, again so as to achieve the result that no portion of the material forming the core rope sling is visible to the unaided eye after the braided sheath has been formed about the splice braid zone of the core rope sling.

Step Twenty-One: a "removable void spacer" is provided. The void spacer may have its terminal ends bent at ninety degrees or otherwise not parallel to the axis of the main length of the void spacer, with such terminal ends' long dimensions preferably both aimed in a similar orientation. A preferable removable void spacer is formed of a hollow steel tube such as a hollow steel pipe having a steel eye welded at one end of the pipe and having a high quality steel cable of suitable diameter doubled over and inserted into the other end of the steel pipe and held in place by solidifying a molten bead weld inside the end of the pipe. The result of such a construction method for a removable void spacer is a removable void spacer designed and configured so as to result in a hollow steel pipe having a loop of high grade steel wire protruding at one end and having a steel eye affixed to its other end, such as may be a link of steel chain welded to such other end of the hollow steel pipe. Such preferable removable void spacer shall be known as "the preferred removable void spacer".).

Step Twenty-Two: a preferred void spacer is situated alongside the splice braid zone that is most proximal the braid point in such a fashion that the steel eye of the preferred void spacer as well as some length of the steel pipe of the preferred void spacer is lying alongside the braided sheath while the majority of the preferred void spacer's steel pipe is lying alongside the core rope sling's still uncovered splice braid zone in such a fashion that the steel pipe ends and the steel wire loop commences where the exposed splice braid zone meets its open spliced eye. To effectively so position the preferred void spacer, it is needed to first insert the preferred void spacer into the interior zone of the converging braid strands, and then to withdraw that portion of it that is to lie alongside the braided sheath by passing the steel eye of the preferred void spacer through the converging strands forming the braided sheath proximal where such strands enter the braid point. Step Twenty-Three: the take up wheel is now again reversed from its take up direction to rather a pay out direction so as to cause the braid tension to become reduced and also so as to cause the braid angle to become more obtuse, until the braid angle is nearer to eighty-nine degrees than it is to seventy degrees when measured between the braid ring and a converging strand used in forming the hollow braided sheath, with a braid angle of about eighty to eighty-seven degrees being also useful, with the result that the core rope sling's material is not visible to an unaided eye after the braided sheath has been formed about the splice braid zone of the core rope sling.

Step Twenty-Four: the action of the braiding machine is then commenced again, causing the braided sheath to form about the splice braid zone.

Step Twenty-Five: the action of the braiding machine is again commenced including that the take up spool again commences to rotate in a "take up" direction until the braided sheath is formed to about the location where the splice braid zone meets its open eye.

Step Twenty-Six: The braiding machine's operations are again paused.

Step Twenty-Seven: a connecting line connecting the two open eyes most proximal the braiding point is severed, and that open eye having its splice braid already covered by the braided sheath is withdrawn from within the interior zone of the converging braid strands in a similar manner as described supra for withdrawing an open eye from within such interior zone of converging braid strands, and the other eye is retained on a hook that is provided underneath the braid point.

Step Twenty-Eight: The braiding machines action is again started so as to cause more hollow braided sheath to be formed downstream of the withdrawn eye, the length of hollow braided sheath to be formed again corresponding to about two times the length of the splice braid zones present on the core rope slings plus an additional about twenty centimeters of length.

Step Twenty-Nine: when about half the intended overall length of the hollow braided sheath being formed in the above step is completely formed, the braiding machine is again paused and a section of twine is attached at the braid point to the strands forming the hollow braided sheath, said section of twine being about twice the length of a splice braid zone to be coverbraided, and said section of twine being retained outside of the converging braid strands. This section of twine is hereinafter also known as the "next eye connecting twine". Step Thirty: the braiding machine is again started and operated until the intended length of the hollow braided sheath is formed.

Step Thirty-One: The eye of the core rope sling that has been retained on a hook underneath the braid point is now inserted into the interior zone of the converging braid strands, and then withdrawing from such interior zone of converging braid strands in the fashion as described above for withdrawing eyes from such interior zone of converging braid strands, while the splice braid zone corresponding to this eye is retained within the interior zone of the converging braid strands so that it can be coverbraided. This eye is then attached to the next eye connecting twine.

Step Thirty-Two: The length of hollow braided sheath is severed about in half.

Step Thirty-Three: While the braiding action of the braiding machine is retained as paused, the take up spool is energized so as to advance downstream the hollow braided sheath and the braid point, thus tightening the eye connecting twine that connects the hollow braided sheath and the withdrawn eye.

Step Thirty-Four: the downstream severed end of the braided sheath is inserted into the open portion of the steel wire loop forming the terminal end of that void spacer nearest the end of that eye already having had its splice braid zone coverbraided and also having the preferred void spacer situated proximal its splice braid zone. The severed end may be frayed prior to being so inserted. Then the severed end is bend back, that is doubled over the steel wire loop, and held in place by hand by being squeezed together with the other portion of the hollow braided sheath near the steel wire loop. The severed ends may be wrapped tightly with tape and then cut into a spiked, tapered shape to facilitate such insertion and retention.

Step Thirty-Five: the preferred void spacer is pulled out (i.e. is withdrawing) from between the sheath and the core rope, in a direction that draws the severed end of the braided sheath into within the braided sheath and causes it to occupy a position between the braided sheath and the core rope's splice braid zone that previously was occupied by the preferred void spacer. A hydraulic or pneumatic ram is useful for so withdrawing the preferred void spacer. Optionally, a lubricant may be added to assist in drawing the severed hollow braided sheath into position. Such lubricant also may be used to lubricate the preferred void spacer prior to its use. Such lubricant is especially useful should the braided sheath be formed of highly inelastic materials such as UHMWPE and others. This step may be made either when the portion of splice braid zone with the preferred void spacer is upstream of or downstream of the take up wheel, so long as tension is maintained on the coverbraided core rope sling so as to permit withdrawing the preferred void spacer. The take up wheel may be cushioned or padded to permit the preferred void spacer to pass over it under tension without damaging either the product being formed of the machinery.

To produce further and subsequent spliced eye slings of the rope of the present disclosure, the actions, steps, methods and processes described in Steps Fourteen and onward are now repeated in the order and sequence as described hereinabove in order to produce the next spliced eye sling of the rope of the present disclosure. Then, the Steps Fourteen and onward may again be repeated, each time they are repeated another sling of the rope of the present disclosure being formed, until the linear element formed from the interconnected core rope slings is consumed. Then, Steps One and onward are repeated in order to form more slings of the rope of the present disclosure as desired.

Preferably, prior to splicing the eyes into any section of core rope so as to form a core rope sling, a very abrasion resistant, very durable sheath is slid upon the core rope and maintained in a region corresponding to any intended open eye to be formed, thereby resulting in a sheathed eye. The best construction for such a sheath is a hollow braided construction that has been made rigid by use adhesives and by forming a hollow braid of very tight wraps about a rod or rope that is then removed from such hollow braid where such rope or rope has a diameter that is sufficiently larger than the diameter of the core rope to be sheathed so that it is not difficult to pass the body of the core rope into the sheath. The rigidity imparted to any eye by such sheath greatly facilitates handling of the eyes in the production process of the present disclosure, and also greatly increases longevity of the spliced eye.

It is important that the braid angle and the elasticity of fibers forming both the braided sheath and forming the strength member of either the rope of the present disclosure or of the spliced eye slings of the rope of the present disclosure, or of any other rope or of any other sling of the present disclosure, are selected so that the braided sheath and the strength member core or their equivalents both experience total failure at the same elongation of the final produced rope or its counterparts. For example, when less elastic fibers form the braided sheath, and more elastic fibers form the strength member core rope, the strength member core rope's strands are of a less obtuse braid angle than are the strands forming the braided sheath.

Further Preferred Fabrication Methods

When the rope of the present disclosure is to be used with high tension powered blocks, it is advantageous to have the disclosed thermoplastic core within the rope of the present disclosure. In such instances of having the thermoplastic core within the rope of the present disclosure, that portion of the thermoplastic core corresponding to those portions of the core rope of the present disclosure to be used in forming the splice braid zone and optionally as well any open eye preferably is removed prior to the splice being formed. Then, the core rope sling having the thermoplastic core is coverbraided so as to form a tightly coverbraided spliced eye sling having a thermoplastic core. It is to be noted that the thermoplastic core is itself contained within a sheath the stops molten and especially semi liquid phases of the thermoplastic core from exiting the rope during extreme pressure. A preferred production process of the present disclosure for producing ultra high strength light weight ultra compacted spliced coverbraided rope slings of the present disclosure is as follows:

First: a thermoplastic core is provided, with or without lead inside the core for weight, and with or without inside the core insulated conductors designed and configured to tolerate being permanently stretched as needed to survive the production process now being disclosed. Polyethylene is a good material for most thermoplastic cores for this process.

Second: the thermoplastic core is enclosed within a sheath that is able to stop molten phases of the thermoplastic core from exiting the sheath or that is able to mainly stop molten phases of the thermoplastic core from exiting the sheath. Such a sheath can be formed of very densely and tightly braided polyester fibers or other fibers having a higher softening point than the softening point of the thermoplastic core. Third: a strength member is formed about the combination of the thermoplastic core and the sheath enclosing the thermoplastic core. Preferred materials for forming the strength member are fibers formed of materials that are able to be creeped. For example, fibers of UHMWPE, such as Dyneema®. Creeped as used in this disclosure means that the fibers are able to be permanently elongated a certain percentage of their initial length under a certain tension and at a certain temperature, especially a temperature just lower than a phase change temperature of the material forming the fibers, without compromising the fibers integrity and long term usefulness, and preferably also without compromising the fibers strength. A preferred construction for forming the strength member is a braided construction and especially a hollow braided construction.

Fourth: an eye is spliced into one or both ends of the strength member, with a portion of the thermoplastic core corresponding to any intended splice braid zone being removed from the intended splice braid zone prior to completion of the splicing process and the sheath enclosing the thermoplastic core being tied off and knotted so as to become sealed, rather than left cut open, thereby stopping flow of future molten phases of the thermoplastic core from exiting the sheath. The result is an alternative core rope sling.

Fifth: the alternative core rope sling is transformed into an alternative coverbraided spliced eye sling using the process of the present disclosure for forming spliced eye slings of the present disclosure. A preferred material for forming strands forming the coverbraid is a material such as Dyneema or other UHMWPE. A settable adhesive substance, or a substance capable of being phase changed into an adhesive substance, where such adhesive substances have an elasticity as taught herein for a settable adhesive substance, including an elasticity of at least 10% at between zero degrees centigrade and negative fifteen degrees centigrade, and more preferably an elasticity of at least 50% at such temperatures, and more preferably an elasticity up to and even exceeding 550% at such temperatures and at temperatures that exceed sixty degrees centigrade preferably is situated about the outside of the strength member core, i.e. about the outside of the alternative core rope sling, just prior to the convergence of strands forming the coverbraided sheath about the outside of the alternative core rope sling. That is, just prior to the formation of any sheath about the alternative core rope sling. However, care is taken to not situate the settable adhesive substance or its equivalent about those portions of the strength member and/or core rope sling corresponding the any splice braid zone, and the method of the present disclosure includes a step of preventing the settable adhesive substance and/or the second synthetic portion from being formed about portions of the strength member and/or core rope sling that correspond to a splice braid zone.

Sixth: excess of such adhesive substances are removed from the outside of the braided sheath.

Seventh: the alternative coverbraided spliced eye sling formed in the above step and of the combination of the alternative strength member and the sheath enclosed thermoplastic core are next subject to a tension that preferably is lesser than 50% of the break strength of the alternative strength member, and more preferably is less than 30% of such break strength, and yet more preferably is less than 20% of such break strength, and yet more preferably is less than 15% of such break strength, and yet again more preferably is less than 10% of such break strength, and even yet again is more preferably less than 7% of such break strength, even more preferably is less than 5% of such break strength, with about 3% of such break strength being preferred and with lesser than 3% being useful Eighth: The combination of the tensioned alternative strength member and the sheath enclosed thermoplastic core are next subjected to a heat that is regulated and applied in such a fashion so as to cause all or at least the majority of the fibers forming the strength member core to approach near to, but to remain at lower than, their phase change temperature, while simultaneously causing the thermoplastic core to change to a molten phase. It is worth noting that the disclosed steps of first applying the disclosed tension to the alternative strength member, whether or not it is already used in forming either or both the alternative core rope sling or the alternative coverbraided spliced eye sling, and then subsequently applying the disclosed heat to at least the alternative strength member, again whether or not it is already used in forming either or both the alternative core rope sling or the alternative coverbraided spliced eye sling, is contrary to the trend in the industry and against the state of the art, and has been found to surprisingly result in a stronger rope of the present disclosure.

Ninth: the tension and temperature are maintained until a desired amount of elongation of the strength member core can be detected, and preferably until it is detected.

Tenth: While the tension is maintained on the strength member, whether or not it is already used in forming either or both the alternative core rope sling or the alternative coverbraided spliced eye sling, and thus by extension also on the sheath enclosed thermoplastic core as well as on anything enclosed within the alternative strength member, the combination of any or all of the alternative coverbraided spliced eye sling; the alternative strength member and the sheath enclosed thermoplastic core and anything else contained within the strength member is cooled until the thermoplastic core has reach a solid phase, resulting in a high strength light weight synthetic rope sling useful for all the above mentioned uses.

Preferably, prior to splicing the eyes into the alternative core rope in order to form the alternative core rope sling, the above mentioned very abrasion resistant, very durable sheath is slid upon the alternative core rope and maintained in a region corresponding to any intended open eye to be formed, thereby resulting in a sheathed eye. As taught above, the rigidity imparted to any eye by such sheath greatly facilitates handling of the eyes in the production process of the present disclosure, and also greatly increases longevity of the spliced eye.

INDUSTRIAL APPLICABILITY

A rope may be formed by use of the teachings of the present disclosure where such rope's intended use does not necessitate that the rope either require tolerating the compressive forces generated on high tension winches and drums, nor necessitate that the rope exhibit the preferred rope elasticity and/or elasticity to break point values as taught herein. In such embodiments, a strength member is formed and the subsequent steps are carried out the same as taught above and herein.

Although the present disclosure has been described in terms of the presently preferred embodiment, it is to be understood that such disclosure is purely illustrative and is not to be interpreted as limiting. Consequently, without departing from the spirit and scope of the disclosure, various alterations, modifications and/or alternative applications of the disclosure are, no doubt, able to be understood by those ordinarily skilled in the art upon having read the preceding disclosure. Accordingly, it is intended that the following claims be interpreted as encompassing all alterations, modifications or alternative applications as fall within the true spirit and scope of the disclosure.

The invention claimed is:

1. A mainly synthetic rope (1) produced by a process for producing a mainly synthetic rope (1), the process having steps of:

a) providing a strength member (7) formed mainly of synthetic material;

b) situating about the outside of the strength member (7) a substance capable of exhibiting during at least one of its phases an adhesive substance (9) exhibiting a certain elasticity at a certain temperature range, the process characterized by steps of:

(i) selecting for at least the strength member (7) at least a strength member (7) formed mainly of synthetic material;

(ii) selecting for a sheath (8) at least a braided sheath;

(iii) selecting for the adhesive substance (9) a substance that:

a) is capable of adhering the strength member (7) to the braided sheath (8) that is formed about the strength member (7); and b) exhibits:

(i) a minimal elasticity of greater than 8% when at a temperature of between negative twenty and negative fifteen degrees Centigrade; and (ii) a minimal elasticity of greater than 10.1% when at a temperature of between negative fifteen and negative five degrees Centigrade; and c) forming the braided sheath (8) about the combination of the strength member (7) and the substance capable of exhibiting during at least one of its phases the adhesive substance (9) exhibiting the selected certain elasticity at the certain temperature range, and selecting to form the braided sheath (8) about the combination of the strength member (7) and the substance capable of exhibiting during at least one of its phases the adhesive substance (9) exhibiting the selected certain elasticity at the certain temperature range when the substance is in a flowable state.

2. The mainly synthetic rope (1) of claim 1 wherein the process includes a further step of selecting to combine at least two substances in order to form the substance capable of exhibiting during at least one of its phases the adhesive substance (9).

3. The mainly synthetic rope (1) of claim 2 wherein the process includes a further step of selecting to combine the at least two substances that form the substance capable of exhibiting during at least one of its phases the adhesive substance (9) prior to situating about the outside of the strength member the combination of the at least two substances that form the substance capable of exhibiting during at least one of its phases the adhesive substance (9).

4. The mainly synthetic rope (1) of claim 1 wherein after step "c" of claim 1 the process further comprises a step of selecting to distribute about the outside surface of the braided sheath the flowable substance.

5. The mainly synthetic rope (1) of claim 4 wherein the process further comprises a step of selecting to form the braided sheath (8) about the combination of the strength member (7) and the substance capable of exhibiting during at least one of its phases the adhesive substance (9) exhibiting the selected certain elasticity at the certain temperature range when the substance is in a liquid state.

6. The mainly synthetic rope (1) of claim 1 wherein the process further comprises a step of selecting for a final set phase of the adhesive substance (9) a substance that has an elasticity of at least 20% when measured at any temperature within two degrees Centigrade of zero degrees Centigrade.

7. The mainly synthetic rope (1) of claim 1 wherein the process further comprises an additional step of selecting for the strength member (7) a strength member having a core (3) where the core (3) supports the strength member's (7) natural internal shape.

8. The mainly synthetic rope (1) of claim 1 wherein the process further comprises an additional step of using a blending machine to blend liquid portions together to form a flowable state of the substance that is situated upon the at least the outside surface of the strength member (7).

9. The mainly synthetic rope (1) of claim 1 wherein the process further comprises a step of selecting for the adhesive substance a substance that when set shall have greater elasticity than the elasticity of the strength member (7) upon which the substance is being situated.

10. The mainly synthetic rope (1) of claim 1 wherein the process further comprises an additional step of selecting to form the strength member of filaments having filaments that are able to be creeped.

11. The mainly synthetic rope (1) of claim 10 wherein the process further comprises additional steps of: first, applying tension to at least the strength member; second, after applying the tension to at least the strength member, maintaining the tension on at least the strength member; subsequently, while maintaining the tension on at least the strength member, applying a heat to at least the strength member; and selecting a combination of the tension and the heat so as to cause creep of those filaments of the strength member that are the filaments that are able to be creeped.

12. The mainly synthetic rope (1) of claim 1 wherein the process further comprises a step of selecting a temperature of lesser than eighty degrees Centigrade for a temperature of the substance capable of exhibiting during at least one of its phases the adhesive substance (9) when situating about the outside of the strength member (7) the substance capable of exhibiting during at least one of its phases the adhesive substance (9).

13. A process for producing a mainly synthetic rope (1) capable of being used with powered blocks, the process having steps of:

a) providing a core (3) capable of supporting a hollow strength member and capable of fitting within an internal cavity formed by a hollow strength member;

b) forming a synthetic strength member (7) about the core, the strength member (7) formed mainly of synthetic fibers;

c) situating about the outside of the strength member (7) a substance (9) capable of being, during at least one of its phases, a substance capable of adhering a substance forming the strength member to a substance forming a sheath; and d) forming a sheath (8) about the outside of both the strength member (7) and the substance capable of being, during at least one of its phases, a substance capable of adhering the substance forming the strength member (7) to the substance forming the sheath (8), the process characterized by a step of selecting at least for the substance (9) capable of adhering at least the substance forming the strength member to at least the substance forming the sheath at least a substance having an elasticity that is greater than the elasticity of the core (3).

14. The mainly synthetic rope (1) of claim 13 wherein the elasticity is at least twenty percent when measured at any temperature within two degrees Centigrade of zero degrees Centigrade.

15. A mainly synthetic rope (1) formed of at least a strength member (7) and at least a sheath (8), the strength member (7) and the sheath (8) both formed of at least a synthetic material, the mainly synthetic rope (1) characterized by the fact that:

a) at least a synthetic substance (9) occupies void spaces between at least the strength member (7) and at least the sheath (8) and at least adheres the strength member (7) to the sheath (8), where the synthetic substance (9) exhibits when in a set phase and when at a temperature of between negative twenty and negative fifteen degrees Centigrade at least a minimal elasticity of 8%.

16. The mainly synthetic rope of claim 15 wherein the sheath is a braided sheath.

17. The mainly synthetic rope of claim 15 wherein the strength member includes an impregnation material that measurably increases the mainly synthetic rope's splice strength when wet with water.

18. The mainly synthetic rope of claim 15 wherein the adhesive synthetic substance (9) also contacts at least portions of the outside surface of the sheath.

19. The mainly synthetic rope of claim 15 wherein the strength member (7) is formed of filaments having filaments that are able to be creeped.

20. The mainly synthetic rope of claim 19 wherein the strength member (7) is formed by a process, the process including steps of: first, applying tension to at least the strength member; second, after applying the tension to at least the strength member, maintaining the tension on at least the strength member; subsequently, while maintaining the tension on at least the strength member, applying a heat to at least the strength member; and selecting a combination of the tension and the heat so as to cause creep of those filaments of the strength member that are the filaments that are able to be creeped.

21. A mainly synthetic rope (1) having a strength member (7) formed mainly of synthetic material; a first synthetic portion (3); and a second synthetic portion (9), the first synthetic portion (3) being mainly enclosed within the strength member (7) and the second synthetic portion (9) being situated at least external the strength member (7), at least a portion of the second synthetic portion (9) also being situated at least internal a sheath (8) formed about at least the strength member (7), the second synthetic portion (9) being formed of a substance capable of being, during at least one of its phases, a substance capable of adhering at least a substance forming the strength member (7) to at least a substance forming the sheath (8), the mainly synthetic rope characterized in that the first and second synthetic portions have differing elasticity values, the second synthetic portion having greater elasticity than the first synthetic portion, whereby provided is a mainly synthetic rope capable of being used in conjunction with powered blocks.

22. The mainly synthetic rope of claim 21 wherein the first synthetic portion is a shaped supportive core.

23. The mainly synthetic rope of claim 21 wherein the second synthetic portion is formed of an adhesive substance adhering the sheath to the strength member.

24. The mainly synthetic rope of claim 21 wherein the strength member further comprises at least a synthetic substance situated about and between fibers forming the strength member, the synthetic substance situated about and between fibers forming the strength member capable of being an adhesive substance that has an elasticity that is lesser than the elasticity of the second synthetic portion.

* * * * *